US012054867B2

(12) United States Patent
Kallenbach et al.

(10) Patent No.: US 12,054,867 B2
(45) Date of Patent: Aug. 6, 2024

(54) SEWING MACHINE

(71) Applicant: PFAFF Industriesysteme und Maschinen GmbH, Kaiserslautern (DE)

(72) Inventors: Harald Kallenbach, Heltersberg (DE); Berthold Becker, Rimbach (DE); Stefan Samstag, Lorsch (DE)

(73) Assignee: PFAFF Industriesysteme und Maschinen GmbH, Kaiserslautern (DE)

( * ) Notice: Subject to any disclaimer, the term of this patent is extended or adjusted under 35 U.S.C. 154(b) by 75 days.

(21) Appl. No.: 17/800,965

(22) PCT Filed: Feb. 12, 2021

(86) PCT No.: PCT/EP2021/053556

§ 371 (c)(1),
(2) Date: Aug. 19, 2022

(87) PCT Pub. No.: WO2021/165163

PCT Pub. Date: Aug. 26, 2021

(65) Prior Publication Data

US 2023/0077246 A1 Mar. 9, 2023

(30) Foreign Application Priority Data

Feb. 21, 2020 (DE) ..... 10 2020 202 270.4

(51) Int. Cl.
*D05B 85/06* (2006.01)
*D05B 1/12* (2006.01)
*D05B 57/22* (2006.01)

(52) U.S. Cl.
CPC ..... *D05B 85/06* (2013.01); *D05B 1/12* (2013.01); *D05B 57/22* (2013.01)

(58) Field of Classification Search
CPC . D05B 1/24; D05B 1/12; D05B 55/08; D05B 57/22; D05B 85/06; D05B 1/08
See application file for complete search history.

(56) References Cited

U.S. PATENT DOCUMENTS 1,322,510 A * 11/1919 Arbetter ..... D05B 85/06 112/177
1,323,340 A 12/1919 Weis
(Continued)

FOREIGN PATENT DOCUMENTS

DE 671983 C 2/1939
DE 906403 C 1/1954
(Continued)

OTHER PUBLICATIONS

Federal Service for Intellectual Property, Office Action in related Russian application 2022121040/03(044339), May 16, 2023 (English translation).

(Continued)

*Primary Examiner* — Danny Worrell
(74) *Attorney, Agent, or Firm* — Smartpat PLC

(57) ABSTRACT

A sewing machine has seam-forming tools, comprising a needle for guiding an upper thread and a looper. The needle is designed as a curved needle which is pivotable about a needle pivot axis. This embodiment is such that a distance of the curved needle from the pivot axis is equal to a radius of a curve of the curved needle about the pivot axis. The looper is designed as a looper which is rotatable about a looper rotational axis and has a lower thread reserve. The looper rotational axis runs parallel to a sewing material support region. The sewing machine can be used to produce a durable seam.

11 Claims, 2 Drawing Sheets

(56) References Cited

U.S. PATENT DOCUMENTS

| | | | | | |
|---|---|---|---|---|---|
| 2,687,103 | A * | 8/1954 | Mosberg | D05B 1/24 | 112/176 |
| 3,734,039 | A * | 5/1973 | Krasnitz | D05B 1/24 | 112/176 |
| 4,252,072 | A * | 2/1981 | Draghicchio | D05B 57/02 | 112/199 |
| 4,527,564 | A | 7/1985 | Eguchi et al. | | |
| 4,712,495 | A * | 12/1987 | Jagielski | D05B 1/24 | 112/176 |
| 5,095,833 | A * | 3/1992 | Darrieux | D04H 3/07 | 112/412 |
| 5,253,600 | A * | 10/1993 | Sugahara | D05B 55/08 | 112/222 |
| 5,381,743 | A | 1/1995 | Moll | | |
| 5,829,373 | A * | 11/1998 | Baxter | D05B 1/24 | 112/176 |
| 6,470,814 | B2 * | 10/2002 | Keilmann | D05B 1/24 | 112/176 |
| 2002/0035955 | A1 | 3/2002 | Keilmann | | |
| 2016/0052465 | A1 | 2/2016 | Wenzel et al. | | |
| 2017/0246837 | A1 | 8/2017 | Wenzel et al. | | |
| 2023/0077246 | A1 * | 3/2023 | Kallenbach | D05B 85/06 | |

FOREIGN PATENT DOCUMENTS

| | | | | |
|---|---|---|---|---|
| DE | 1002189 | B | 2/1957 | |
| DE | 2038501 | A1 | 2/1972 | |
| DE | 10040807 | | 7/2004 | |
| DE | 10349127 | A1 | 5/2005 | |
| DE | 102011118813 | | 1/2013 | |
| EP | 0569519 | B1 | 8/1992 | |
| GB | 811956 | A | 4/1959 | |
| SU | 867961 | A1 | 9/1981 | |
| WO | WO-2021165163 | A1 * | 8/2021 | D05B 1/08 |

OTHER PUBLICATIONS

Federal Service for Intellectual Property, office action in related Russian patent application 2022121040/03(044339), Oct. 10, 2023 (English translation).

* cited by examiner

SEWING MACHINE

CROSS-REFERENCES TO RELATED APPLICATIONS

This application claims the priority of German Patent Application, Serial No. DE 10 2020 202 270.4, filed Feb. 21, 2020, the content of which is incorporated herein by reference in its entirety as if fully set forth herein.

FIELD OF THE INVENTION

The invention relates to a sewing machine having a curved needle.

BACKGROUND OF THE INVENTION

Sewing machines of this type are known from DE 103 49 127 A1 and DE 10 2011 118 813 B3. DE 1 002 189 A discloses a double machine, operating without a pricker, having a curved eye needle and straight workpiece feed. DE-PS 906 403 discloses a sewing machine for sewing thick fabrics. DE 100 40 807 A1 discloses a blind stitch sewing mechanism. US 2017/0246837 A1 and US 2016/0052465 A1 disclose a method and apparatus for blind stitching of a formed component.

SUMMARY OF THE INVENTION

It is an object of the present invention to further design a sewing machine of the type mentioned above in such a way that a durable seam can be produced.

This object is achieved according to the invention by a sewing machine having seam-forming tools, comprising a needle for guiding an upper thread and a looper,

- wherein the needle is designed as a curved needle which is pivotable about a needle pivot axis in such a way that a distance of the curved needle from the pivot axis is equal to a radius of a curve of the curved needle about the pivot axis,
- wherein the looper is designed as a looper which is rotatable about a looper rotational axis and having a lower thread reserve,
- wherein the looper rotational axis runs parallel to a sewing material support region,
- wherein an arrangement of the sewing material support region with respect to a movement path of the curved needle is such that the curved needle, during the sewing movement along the movement path, penetrates into sewing material to be sewn from a sewing material side and exits again on the same sewing material side,
- having a design such that the sewing material is sewn in the form of an abutting-edge sewing using a single-sided double lockstitch.

According to the invention, it has been found that the provision of a lower thread via the looper leads to the possibility of providing, in particular, a lockstitch sewing machine that ensures durable sewing of the sewing material by interlacing the lower thread with the upper thread. The lower thread reserve can be designed as a bobbin case accommodated in or at the looper for a lower thread winding. The sewing material support region is at least one surface portion of the sewing machine that defines a relative position of the sewing material to be sewn to the seam-forming tools of the sewing machine. The spatial orientation of the sewing material relative to the sewing material support region is irrelevant in this context. It is therefore irrelevant whether the sewing material rests on the support region or whether the support region rests on the sewing material from above. The fact that the looper rotational axis runs parallel to the sewing material support region simplifies the assembly of the sewing machine. The sewing material support region is arranged in relation to a movement path of the curved needle in such a way that the curved needle penetrates the sewing material to be sewn from one sewing material side during the sewing movement along the movement path and exits again on the same sewing material side. Such an arrangement makes it possible to sew sewing material in the form of a single-sided double lockstitch. In particular, this enables durable abutting-edge sewing of two pieces of sewing material that have been placed against each other. The entry/exit side of the sewing material can face the looper.

The sewing machine can be designed as a hand sewing machine. A weight of the sewing machine may be less than 5 kg, may be less than 4.5 kg, may be less than 4 kg, may be less than 3.5 kg, may be less than 3 kg, may be less than 2.5 kg, may be less than 2 kg, may be less than 1.5 kg, may be less than 1 kg, and may be even less. Regularly, the hand sewing machine has a weight that is greater than 200 g. Such a hand sewing machine is suitable for sewing bulky sewing material or sewing material that is not transportable for other reasons.

A parallel course of the needle pivot axis to the looper rotational axis leads to a simplification of a drive of the seam-forming tools.

An embodiment comprising a design for sewing material thicknesses greater than 8 mm enables the sewing machine to be used even with comparatively large material thicknesses.

A belt drive for driving the curved needle and the looper can be realized in a compact manner. The belt drive, by means of which the curved needle and the looper are driven simultaneously, enables the seam-forming tools of the sewing machine to be synchronized without any effort.

A needle guide groove arranged helically around the curved needle, over which the upper thread (8) is guided, enables the upper thread to be guided securely along the curved needle without the upper thread being released undesirably from the curved needle. The helical shape of the guide groove may be such that the guide groove completes a quarter to half a revolution about a longitudinal axis of the curved needle along the curved needle. A higher number of revolutions of the helical arrangement of the guide groove is also possible, in particular in the range between 0.25 and 2 revolutions.

An embodiment of the invention is explained in more detail below with reference to the drawing.

DESCRIPTION OF THE PREFERRED EMBODIMENT

Figure 1:
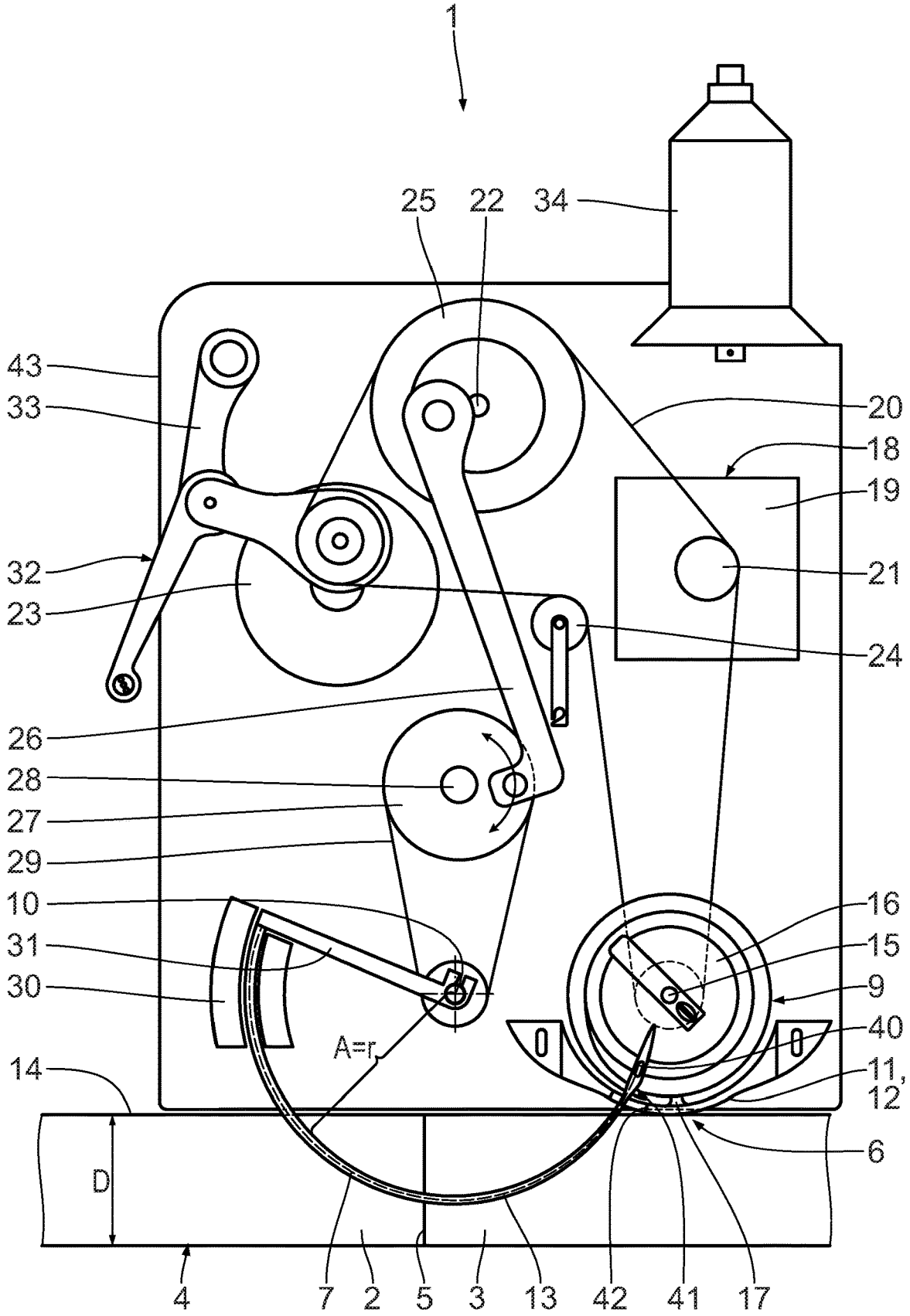
FIG. 1 shows a schematic view of stitch-forming and drive components of a sewing machine upon abutting-edge sewing of two adjacent pieces of sewing material.
Figure 2:
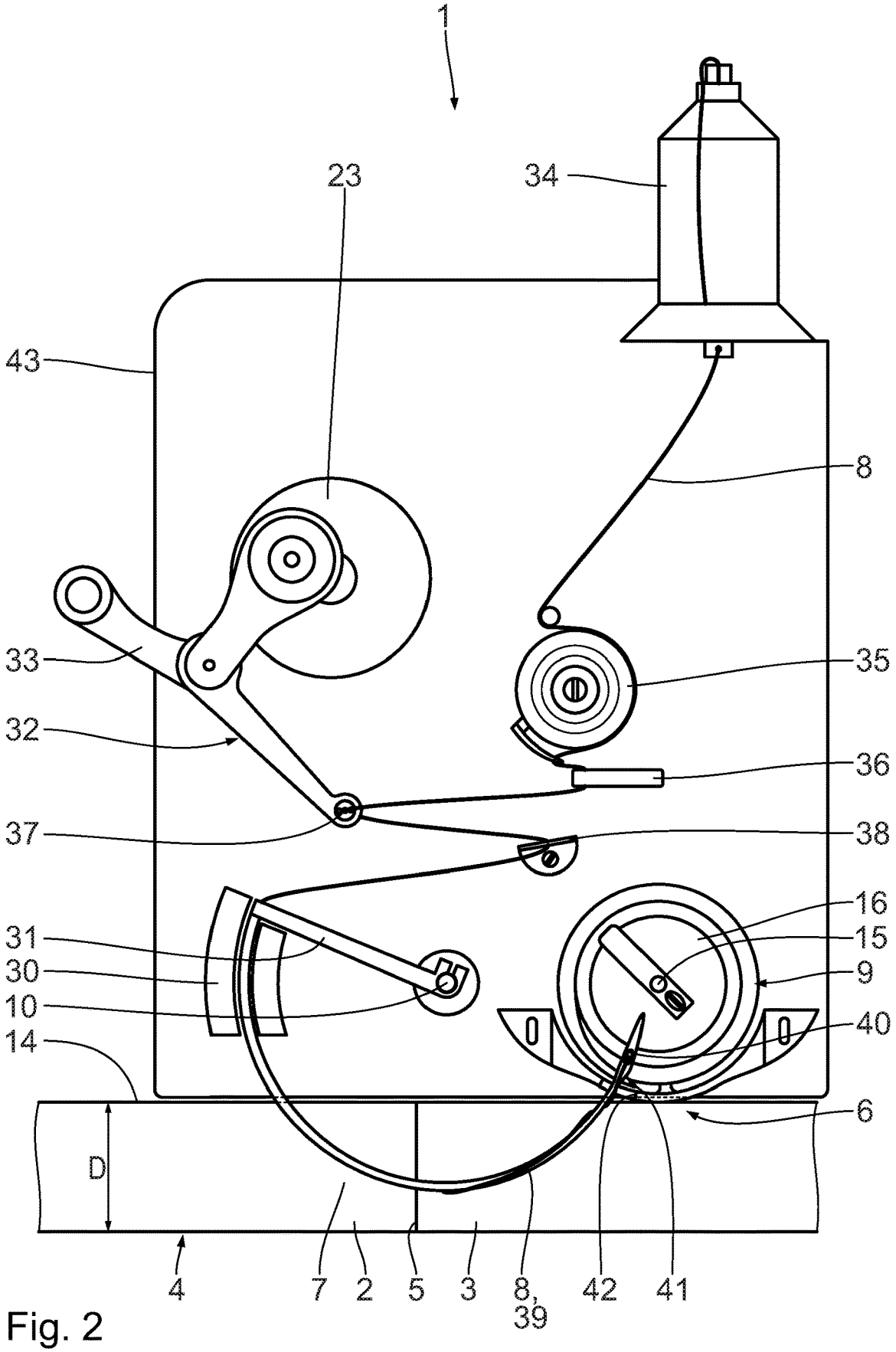
FIG. 2 in an illustration similar to FIG. 1, shows a view of upper thread guide components of the sewing machine.

A sewing machine 1, of which drive and stitch-forming components are shown in FIG. 1 and upper-thread guide components are shown in FIG. 2, serves for abutting-edge sewing of two pieces 2, 3 of sewing material 4 placed end to end. The sewing machine 1 as a whole is designed as a hand sewing machine, i.e. it is not permanently installed for stationary operation and can be held in the hand by an operator during the sewing process. In particular, the sewing machine 1 can be designed without supply lines which are connected to an external supply unit.

The two pieces 2, 3 of the sewing material 4 butt against each other via an abutting edge 5. The sewing machine 1 is designed to sew sewing material 4 having a material thickness D which is greater than 8 mm. The sewing material 4 can have a material thickness in the range between 10 mm and 25 mm, for example.

Seam-forming tools 6 of the sewing machine 1 include a needle 7 for guiding an upper thread 8 (cf. also FIG. 2) and a looper 9.

The needle 7 is designed as a curved needle. The curved needle 7 can be pivoted about a needle pivot axis 10. A distance A between the curved needle 7 and the needle pivot axis 10 is equal to a radius r of a curve of the curved needle 7 about the needle pivot axis 10.

A stitch plate 12 belongs to a sewing material support region 11, which specifies a position of the sewing material 4 relative to the seam-forming tools 6 upon abutting-edge sewing.

The sewing material support region 11 is arranged in relation to a movement path 13 of the curved needle 7, which is indicated by a dashed line in FIG. 1, in such a way that during the sewing movement along the movement path 13, the curved needle 7 penetrates into the sewing material 4 to be sewn from a sewing material side 14, which points upward in FIGS. 1 and 2, and exits again on the same sewing material side 14. This entry/exit sewing material side 14 faces the looper 9. The curved needle does not come out of the sewing material 4 on the sewing material side opposite this entry/exit sewing material side 14.

The looper 9 is rotatable about a looper rotational axis 15 and has a lower thread reserve in the form of a bobbin case 16. The stitch plate 12 has a case stop piece 17 for preventing rotation of the bobbin case about the looper rotational axis 15.

The looper rotational axis 15 runs parallel to the needle pivot axis 10. Both axes 10, 15 run horizontally and perpendicularly to the drawing plane in FIGS. 1 and 2.

The looper rotational axis 15 runs parallel to the sewing material support region 11.

A belt drive 18 having a drive motor 19, which may be an electric motor having a battery supply, and a belt 20 are used to drive the curved needle 7 and the looper 9. The belt 20 is driven via a drive shaft 21 of the drive motor 19 and runs over a main shaft 22, a thread lever eccentric 23, a tension roller 24 and a looper shaft which runs along the looper rotational axis 15.

Via a further eccentric 25, the main shaft 22 is pivotally connected to a swing lever 26, which in turn is eccentrically pivotally connected to a needle drive shaft 28 via a needle drive wheel 27. Via a further belt 29, the needle drive wheel 27 is connected to a needle shaft which runs along the needle pivot axis 10. The shafts 21, 22 and 28 again run parallel to the needle pivot axis 10 and to the looper rotational axis 15. The belt drive with the belts 20, 29 is designed in such a way that the looper 9 rotates twice during a movement period of the curved needle 7. Via the swing lever 26 and the further belt 29, an oscillating drive of the curved needle 7 about the needle pivot axis 10 is achieved, which is synchronized with the rotation of the looper 9 about the looper rotational axis 15. The sewing machine 1 generates a double lockstitch in the sewing material 4 via the seam-forming tools 7, 9 and the belt drive 18 for abutting-edge sewing and thus for durably joining the two pieces 2, 3 of the sewing material 4.

The tension roller 24 is pretensioned against the belt 20 by a tensioning spring and provides sufficient tension to the belt 20. The belt 29 may also have a tension roller not shown in the drawing.

The movement of the curved needle along the movement path 13 is guided by a frame-fixed curve guide 30. The curved needle 7 is connected to the needle shaft by a needle holder 31.

A thread lever 32 of the sewing machine is driven via the thread lever eccentric 23. The thread lever 32 has a thread lever arm 33.

FIG. 2 additionally shows upper thread guide components of the sewing machine 1. The upper thread 8 is fed via an upper thread reserve in the form of a thread reel 34. From there, the upper thread 8 first runs over a thread pretensioning unit 35 and a thread deflection eyelet 36. From there, the upper thread 8 runs over a thread lever eyelet 37 and another thread deflection eyelet 38 to a guide groove 39, which is arranged helically in a jacket wall of the curved needle 7. At this free end, the curved needle 7 has an eye 40.

A plane of the movement path 13, which runs parallel to the drawing plane of FIG. 1, is offset perpendicularly to the drawing plane of FIG. 1 with respect to a movement path of a looper tip 41 of the looper, so that the looper tip 41 can run past a needle tip of the curved needle 7 when gripping an upper thread loop upon stitch formation. The needle tip of the curved needle 7 having the eye 40 passes through a stitch hole 42 in the stitch plate 12.

As far as possible, the seam-forming tools 6 and the upper thread guide components are accommodated in a housing 43 of the sewing machine 1 (cf. FIG. 2).

The invention claimed is:

1. A sewing machine (1) having seam-forming tools (6), comprising a needle (7) for guiding an upper thread (8) and a looper (9), wherein the needle (7) is a curved needle (7) which is pivotable about a needle pivot axis (10), wherein a distance (A) of the curved needle (7) from the pivot axis (10) is equal to a radius (r) of a curve of the curved needle (7) about the pivot axis (10), wherein the looper (9) is rotatable about a looper rotational axis (15) and has a lower thread reserve (16), wherein the looper rotational axis (15) runs parallel to a sewing material support region (12), wherein the sewing material support region (11) is arranged with respect to a movement path (13) of the curved needle (7) such that the curved needle (7), during a sewing movement along the movement path (13), penetrates into a first piece (2) of a sewing material (4) to be sewn from a sewing material side (14), exits the first piece (2) and enters a second piece (3) of the sewing material (4) along an abutting edge (5), and exits the second piece (3) of the sewing material (4) on the sewing material side (14), whereby the first piece (2) and the second piece (3) of the sewing material are sewn to one another by abutting-edge sewing with a single-sided double lockstitch.

2. The sewing machine according to claim 1, wherein the needle pivot axis (10) runs parallel to the looper rotational axis (15).

3. The sewing machine according to claim 1, wherein the lower thread reserve (16) is designed as a bobbin case accommodated in or at the looper (9) for a lower thread winding.

4. The sewing machine according to claim 1, wherein a thickness (D) of the sewing material (4) is greater than 8 mm.

5. The sewing machine according to claim 1, comprising a belt drive (18) for driving the curved needle (7) and the looper (9).

6. The sewing machine according to claim 1, wherein the curved needle (7) has a guide groove (39) arranged helically around the curved needle (7), over which the upper thread (8) is guided.

7. The sewing machine according to claim 1,
wherein the sewing material support region (11) includes a stitch plate (12) that secures a position of the sewing material (4) relative to the seam-forming tools (6) during the abutting-edge sewing.

8. The sewing machine according to claim 1,
wherein the abutting edge (5) extends perpendicular to the sewing material side (14).

9. The sewing machine according to claim 1,
wherein the abutting-edge sewing durably joins the first piece (2) to the second piece (3) of the sewing material (4).

10. The sewing machine according to claim 5,
wherein the belt drive (18) includes
a belt (20),
a needle drive wheel (27),
an eccentric (25), and
a swing lever (26) connecting the eccentric (25) to the needle drive wheel (27),
wherein the belt (20) drives the looper (9) into rotation and the curve needle (7), through
the eccentric (25), the needle drive wheel (27) and a further belt, into oscillation, and
wherein the looper (9) rotates twice during a movement period of the curved needle (7).

11. The sewing machine according to claim 10,
wherein the belt drive (18) further includes a thread lever (32) with a thread lever arm (33) that is driven by the belt (20) via a thread lever eccentric (23).

* * * * *